United States Patent [19]

Oglesby

[11] 3,938,486

[45] Feb. 17, 1976

[54] PNEUMATICALLY CONTROLLED FUEL INJECTION SYSTEM

[75] Inventor: Cecil D. Oglesby, Manchester, Mo.

[73] Assignee: Borg-Warner Corporation, Chicago, Ill.

[22] Filed: Apr. 18, 1974

[21] Appl. No.: 461,829

[52] U.S. Cl. ..... 123/119 R; 123/DIG. 10

[51] Int. Cl.[2] ..... F02B 33/00

[58] Field of Search ..... 123/DIG. 10, 119 R

[56] References Cited

UNITED STATES PATENTS

| | | | |
|---|---|---|---|
| 3,556,063 | 1/1971 | Tuzson | 123/DIG. 10 |
| 3,585,975 | 6/1971 | Tonegawa | 123/DIG. 10 |
| 3,616,782 | 11/1971 | Matsui | 123/DIG. 10 |
| 3,679,185 | 7/1972 | Nardi | 123/DIG. 10 |
| 3,687,121 | 8/1972 | Tuzson | 123/DIG. 10 |
| 3,690,306 | 9/1972 | Matsui | 123/DIG. 10 |
| 3,690,625 | 9/1972 | Ishida | 123/DIG. 10 |
| 3,756,211 | 9/1973 | Taplin | 123/DIG. 10 |
| 3,766,897 | 10/1973 | Husted | 123/DIG. 10 |
| 3,771,505 | 11/1973 | Taplin | 123/DIG. 10 |
| 3,827,415 | 8/1974 | Makino | 123/DIG. 10 |

*Primary Examiner*—Wendell E. Burns
*Assistant Examiner*—R. H. Lazarus
*Attorney, Agent, or Firm*—Herman E. Smith

[57] ABSTRACT

A fuel system for an internal combustion engine employs fluid logic and amplifier devices for monitoring and processing pressures from both a venturi and inlet manifold to measure the air inducted into the engine and provides pneumatically controlled fuel injection in which fuel is metered in accordance with the air inducted into the engine by means of regulating the time duration of fuel injection.

3 Claims, 9 Drawing Figures

PNEUMATICALLY CONTROLLED FUEL INJECTION SYSTEM

BACKGROUND OF THE INVENTION

In the art of fuel metering, it is known to measure the flow rate of induction air by means of a venturi section which provides a subambient pressure and to employ the subambient pressure for inducing flow of fuel across an orifice such that the flow of fuel is proportional to the flow of air. In practical systems for use with internal combustion engines, it is sometimes necessary to restrict the venturi throat more than would be desirable for proper breathing of the engine in order to provide a pressure signal of sufficient strength for inducing proper fuel flow in the typical operating range of the engine. Further it is generally accepted practice to provide an idle system for metering fuel at low speeds since at low speeds the flow rate of inducted air passing through the venturi section is not sufficient to provide an accurate metering signal. The venturi signal varies in the sense of being stronger at higher flow rates and weaker at lower flow rates.

It is also known to employ a subambient pressure signal derived from the intake manifold of an engine in combination with a fuel injector for metering fuel. The manifold pressure signal varies in the sense of being stronger at lower flow rates and weaker at higher flow rates.

Venturi pressure signals are typically employed with carburetor systems while manifold pressure signals are typically employed with injection systems. Thus, although venturi and manifold pressure signals vary in opposite sense, ordinarily they are not employed to complement each other because they are used in different fuel metering systems.

The prior art includes a fuel system as disclosed in U.S. Pat. No. 3,687,121 wherein fluid logic means are connected for receiving a venturi pressure signal which can be subjected to amplification and modification for use with an injection system.

SUMMARY OF THE INVENTION

The present invention relates to fuel systems for internal combustion engines and more particularly to a fuel system employing both venturi and manifold pressure signals for metering fuel. The fuel system of the present invention includes fluid logic apparatus for transforming dissimilar pressure signals indicative of fuel requirement to intermediate pressures of compatible character indicative of fuel requirement. The present system further includes means for comparing the intermediate pressures and selecting one or the other for regulating the metering of fuel by means of a fuel injector.

DESCRIPTION OF THE PREFERRED EMBODIMENT

Figure 1:
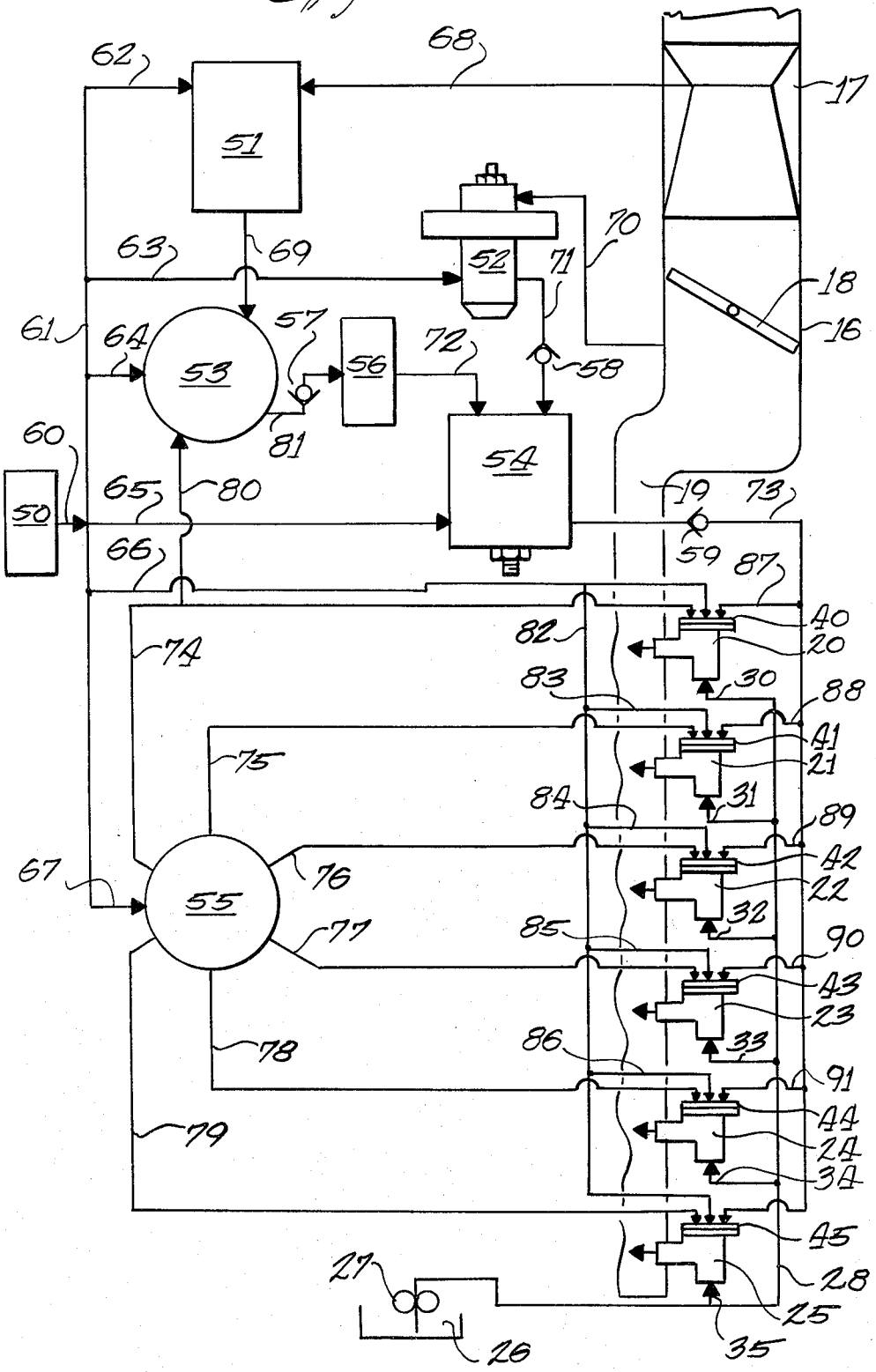
FIG. 1 is a schematic diagram of a fuel system according to the present invention.

Referring now to FIG. 1 of the drawings, there is shown a schematic block diagram of a fuel system according to the present invention, particular components of the system being shown in somewhat more detail in later FIGURES of the drawings.

The induction passages of an internal combustion engine are indicative by reference character 16 and include a venturi portion 17, a throttle plate 18, and a manifold portion 19 below the throttle plate. A group of fuel injectors 20, 21, 22, 23, 24, 25 are shown connected to manifold portion 19 for delivering fuel thereto. Each of the fuel injectors 20 through 25 is connected to a source of fuel represented by sump 26, pump 27, and a common header 28 by means of connecting lines 30, 31, 32, 33, 34, 35. In additon, each injector is equipped with a respective control device 40, 41, 42, 43, 44, 45 for regulating the injection of fuel into manifold portion 19.

The system includes a source of pneumatic fluid under pressure 50 which is connected by means of suitable conduits to each of a first fluid amplifier means 51, a second fluid amplifier means 52, a fluid multivibrator 53, a comparator device 54, and a pneumatic trigger signal generating means 55. Second fluid amplifier means 52 and comparator device 54 can be of a type employing a pneumatically actuated diaphragm for regulating a metering valve. In addition, the system includes a fluid capacitance device 56 connected between multivibrator 53 and comparator 54, as well as a one-way check valve 57 between multivibrator 53 and capacitance 56, a one-way check valve 58 between fluid amplifier 52 and comparator 58, and a one-way check valve 59 between comparator 54 and control devices 40 through 45. Each of control devices 40 through 45 is connected by suitable conduits to the pneumatic fluid source 50, the trigger signal generating means 55, and to the output of comparator 54.

Figure 9:
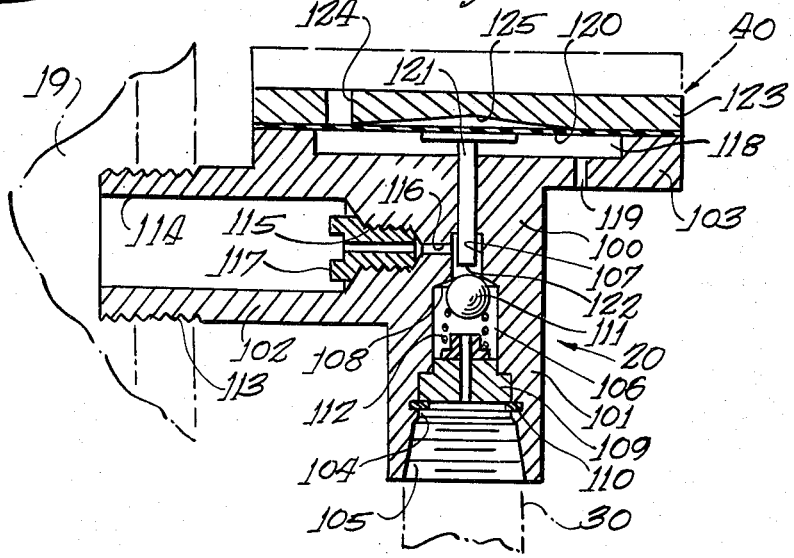
FIG. 9 is a section view of a fuel injector used in the fuel system of FIG. 1.

Referring now to FIG. 9 a typical fuel injector such as injector 20 will be described in more detail. The injector 20 includes a body 100 defining an inlet portion 101, an outlet portion 102, and a head portion 103. Inlet portion 101 includes an inlet port 104 having an internally threaded portion 105 adapted for connection to a source of fuel under pressure as indicated by reference characters 30, 28, 27 and 26 in FIG. 1. Inlet port 104 further includes stepped cavities 106, 107 having a shoulder 108 therebetween defining a valve seat. An orifice bushing 109 is secured in inlet port 104 by means of a retaining ring 110. A check ball 111 is located in cavity 106 and is normally seated against shoulder 108 by means of spring 112 forming a valve structure for controlling admission of fluid from cavity 106 to cavity 107.

Outlet portion 102 includes an externally threaded portion 113 adapted for connection to an inlet manifold portion 19 of an internal combustion engine. Outlet portion 102 includes stepped cavities 114, 115, 116 communicating with internal cavity 107. A fuel jet bushing 117 is secured in cavity 115.

Head portion 103 includes a shallow cavity 118 communicating externally of body 100 by means of vent orifice 119. A diaphragm 120 is secured to head portion 103 covering cavity 118. A plunger 121 engages diaphragm 120 and extends through body 100 into cavity 107 having an end portion 122 engageable with check ball 111 for unseating the ball from seat 108 when diaphragm 120 is deflected into cavity 118. A cover member 123 is secured to head portion 103 above diaphragm 120 and includes a control port 124 and control cavity 125 above the diaphragm.

The operation of valve 20 is such that when a pneumatic control fluid under pressure is supplied to control port 124, diaphragm 120 is deflected downwardly into cavity 118 urging plunger 121 against check ball 111 in the unseating direction permitting fuel to flow from inlet portion 101 to outlet portion 102. The flow of fuel from inlet 101 to outlet 102, and therefore the injection of fuel into manifold 19, corresponds to deflection of diaphragm 120 which in turn corresponds to a rise and fall of pneumatic control pressure at control port 124. Thus intermittent control pulses supplied to control port 124 results in intermittent injection of fuel into manifold 19. As a result, it is possible to correlate fuel injection with the opening of an inlet valve in the engine by means of triggering the control pulses from an engine driven part such as a cam shaft. Furthermore, the amount of fuel injected into the manifold can be regulated by sustaining the time duration of the control pulse. A control device such as 40 for regulating the initiation and duration of control pulses can be mounted on cover member 123 in communication with control port 124.

Figure 7:
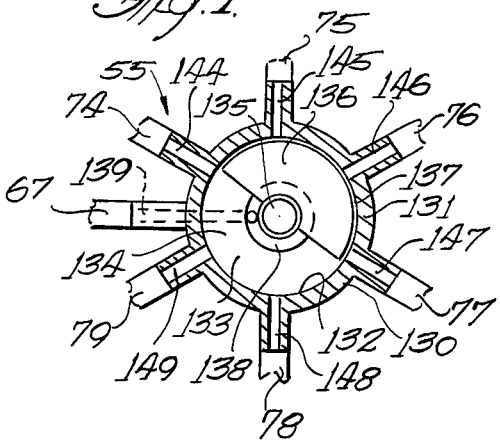
FIG. 7 is a section view of a pneumatic trigger signal generating apparatus used in the fuel system of FIG. 1.

Many forms of pneumatic trigger signal generating apparatus can be used with the fuel system of FIG. 1, and a preferred form of such apparatus is shown in FIG. 7. Trigger signal generator 55 includes a body 130 having sidewalls and an annular wall 131 which defines an apertured internal surface 132. Lower internal surface 133 together with a corresponding upper surface not visible in the section view of FIG. 7, and apertured internal surface 132 define a circular cavity 134 from which radial outlet passages 144 through 149 extend for connecton to conduits 74 through 79. A shaft 135 extends through a lower sidewall into cavity 134 and has a rotor 136 connected thereto, rotor 136 being shown as semicircular in form. An external end of shaft 135 (not visible in the view of FIG. 7) is adapted for connection to a rotating part of an engine such as a cam shaft. Rotor 136 has a particular wall 137 closely adjacent internal surface 132. Lower surface 133 includes an annular groove 138 communicating with an inlet passage 139 which is adapted for communication with a source of pneumatic fluid 50 through conduits 60, 67, such that pneumatic fluid is present in cavity 134. As rotor 136 is rotated in cavity 134, each of outlet passages 144 through 149 is uncovered in turn by wall 137 and then covered by wall 137 once each revolution of shaft 135. Pneumatic fluid flows from cavity 134 to the uncovered passages, thus resulting in the generation of a pressure pulse in each of the passages once each revolution of the rotor, the pressure pulse being terminated once each revolution when the rotor again covers the port. Termination of pressures pulses is employed in control devices 40 through 45 to derive control pressures related to engine speed for operation of respective fuel injectors. As shown in FIG. 7, rotor 136 is approximately semicircular in extent which results in a pulse duration of approximately half a rotation. The rotor may be formed to a greater or lesser angular extent where a different duration of pulse is desired. It should be noted that the pneumatic trigger pulses generated in apparatus 55 have a frequency or repetition rate related to engine speed and a duration related to engine speed and the shape of rotor 136. The trigger pulses formed by generator apparatus 55 are conducted respectively to control devices 40 through 45 which provide control pulses also having a repetition rate related to engine speed but have a duration related to engine load.

Figure 8:
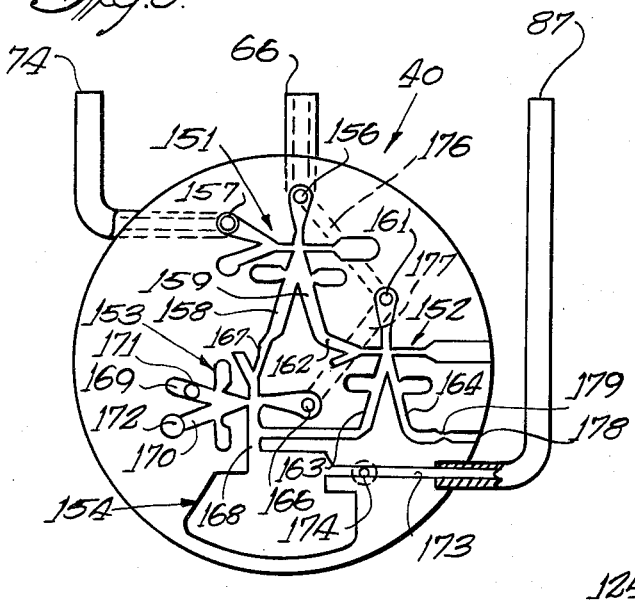
FIG. 8 is a view showing interior passages of a second fluid multivibrator providing control means for a fuel injector used in the fuel system of FIG. 1.

A control device 40 which is typical of control devices 40 through 45 is shown in FIG. 8 with a surface removed to reveal the internal passages thereof. The internal passages of control device 40 form three fluidic gating devices 151, 152, 153 of the OR-NOR type and a capacitance 154 in a fluidic multivibrator configuration. Gating device 151 includes a power port 156, a control port 157, and receiver legs 158, 159. Gating device 152 includes a power port 161, a control port 162, and receiver legs 163, 164. Gating device 153 includes a power port 166, a pair of control ports 167, 168, and a pair of receiver legs 169, 170, receiver leg 169 including a dump port 171 and receiver leg 170 including an output port 172. Capacitance 154 is connected to control port 168 of gating device 153 and also to a source of bias pressure in conduits 87, 73 by means of passage 173 which may include an adjustable fluid restrictor 174, if desired. The power ports 156, 161 and 166 of the gating devices are connected by means of passages 176, 177 to receive pneumatic fluid from source 50 by means of appropriate conduits such as 60, 61 66. Control port 157 of gating device 151 is connected to receive a pneumatic trigger pulse from trigger signal generating means 55 as by means of conduit 74. The fluid capacitance 154 is connected to receive a regulated bias pressure from passage 173 and conduits 87, 73.

The operation of multivibrator control device 40 is as follows. Each of the gating devices is so formed that the left hand receiver leg in each case is the preferred leg, that is to say, that unless a dominating pressure signal is present in the left control port, pneumatic fluid will flow from port 156 to leg 158, from port 161 to leg 163 and from port 166 to leg 169.

When the pressure rise of a trigger pulse is received in control port 157, the jet from port 156 is switched to leg 159 and control port 162 which switches the jet from port 161 to leg 164 where it is dumped to ambient through port 178 and restrictor 179, at the same time the jet from port 166 flows into leg 169 and escapes to ambient through dump port 171. When the trigger pulse is terminated, resulting in a pressure drop in control port 157, the jet from port 156 switches to leg 158 and control port 167 which switches the jet from port 166 to leg 170, while at the same time the jet from port 161 switches to leg 163 flowing to control port 168 and capacitance 154 where it attempts to switch the flow from port 166 back to leg 169. The bias pressure level in capacitance 154 determines the time interval during which flow from jet 166 is allowed to remain in leg 170. Thus if the bias pressure level in capacitance 154 is low, the cancellation signal in leg 163 requires more time to build to an effective cancellation pressure in port 168 thus resulting in a long duration of control pulse in leg 170. On the other hand, if the bias pressure level in capacitance 154 is high, the cancellation pressure in port 168 builds rapidly to an effective cancellation level resulting in a short duration of control pulse in leg 170.

In summary, the control device receives pneumatic fluid from a power supply as by conduit 66, a bias pressure inversely related to engine load as by conduits 87, 73, and a pulsating pneumatic trigger signal related to engine speed as by conduit 74 and provides a series of pneumatic control pulses in output port 172 having a repetition rate related to engine speed and a time duration directly related to engine load. The termination of a trigger pulse in port 157 initiates a control pulse in port 172 and simultaneously generates a cancellation signal for the control pulse which is delayed by capacitance 154. The pneumatic control pulse formed in leg 170 and output 172 is supplied to control port 124 of injector 20 to regulate the frequency and duration of fuel injection into manifold 19.

The bias pressure for the control device is supplied by a comparator device 54 connected to a first circuit portion including devices 51, 53, 56 which processes a venturi pressure signal and to a second circuit portion including device 52 which processes a manifold pressure signal. The venturi pressure signal and manifold pressure signal differ in character from each other and vary in opposite sense with load.

For example, at idle conditions with throttle plate 18 nearly closed, the engine will attempt to evacuate manifold portion 19 creating a strong vacuum or subambient pressure below the throttle plate while at the same time very little air will flow through venturi 17 resulting in a very weak vacuum or subambient pressure in conduit 68. On the other hand at wide open throttle when the engine is consuming a large amount of air the vacuum or subambient pressure in the manifold portion is weak while a large amount of air is passing through the throat of venturi 17 resulting in a strong vacuum or subambient pressure in conduit 68. Thus the subambient pressures in the manifold and at the venturi throat can be said to vary in opposite sense with respect to the air consumed by the engine which is indicative of load and fuel requirement. Moreover, the pressure variations in the manifold and venturi throat differ in character inasmuch as the manifold pressure migrations vary approximately inversely with air requirement whereas the pressure migrations in the venturi throat vary approximately as the square of the rate of flow of the inducted air. The manifold pressure is indicative of load while the venturi pressure is indicative of both speed and load of the engine.

The first and second circuit portions transform the subambient venturi and manifold pressure signals respectively to first and second superambient output pressure signals of a compatible character varying in like sense with load. The first and second output signals are supplied to comparator 54 which provides a bias pressure proportional to one of the first or second output signals. The first and second circuit portions are described in more detail hereinafter.

Figure 2:
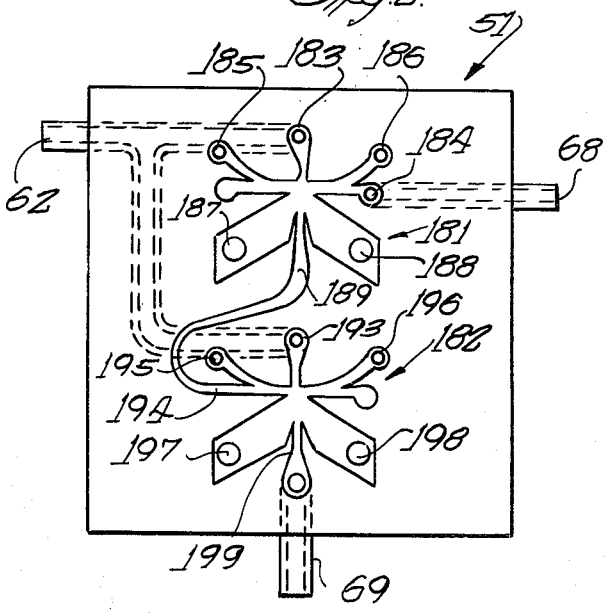
FIG. 2 is a view showing interior passages of a fluid amplifier used in the fuel system of FIG. 1.

The first fluid amplifier 51 of the first circuit portion is shown in more detail in FIG. 2 and comprises a pair of proportional amplifiers 181, 182. Amplifier 181 includes a power port 183, a control port 184, a pair of bias ports 185, 186, a pair of dump ports 187, 188, and a receiver leg 189. Amplifier 182 includes a power port 193, a control port 194, a pair of bias ports 195, 196, a pair of dump ports 197, 198, and a receiver leg 199. The power ports are connected to a source 50 of pneumatic power fluid under superambient pressure by means of conduits 60, 61 and 62. Control port 184 is connected to receive a subambient pressure from the venturi throat by means of conduit 68. Receiver leg 189 is connected to control port 194, and receiver leg 199 is connected to multivibrator 53 by means of conduit 69. Bias ports 185, 186, 195, 196 are connected to ambient by means of trimming orifices which provide fluid resistances. Dump ports 187, 188, 197, and 198 are open to ambient. The relationship between the output and input of a proportional amplifier can be characterized as including a linear region and a quadratic region. It is preferred to bias amplifier 181 for operation in its quadratic region by means of bias ports 185, 186 and to bias amplifier 182 for operation in its linear region by means of bias ports 195, 196.

First fluid amplifier 51 operates in the following manner. A weak subambient pressure in conduit 68 and control port 184 results in a strong superambient pressure in receiver 189 which is conducted to control port 194 where it tends to deflect the jet issuing from power port 193 away from receiver 199 resulting in a weak superambient pressure in receiver 199 and conduit 69. A strong subambient pressure in conduit 68 and control port 184 tends to deflect the jet issuing from power port 183 away from receiver 189 resulting in a weak superambient pressure in receiver 189 and control port 194 which in turn permits more of the jet from power port 193 to enter receiver 199 resulting in a strong superambient pressure in receiver 199 and conduit 69. Moreover, inasmuch as amplifier 181 is biased for operation in its quadratic region, the pressure migrations in receiver 189 vary in accordance with the square root of pressure migrations in control port 184. The amplifier 182, being biased for operation in its linear region provides a response which is linear with the output of amplifier 181. Thus the pressure in receivers 189 and 199 are related to flow rate when the pressure at control port 184 is related to the square of flow rate. In summary, first fluid amplifier is connected to receive a subambient venturi pressure related to the square of flow rate and provides a superambient pressure related to flow rate to the multivibrator 53.

Figure 3:
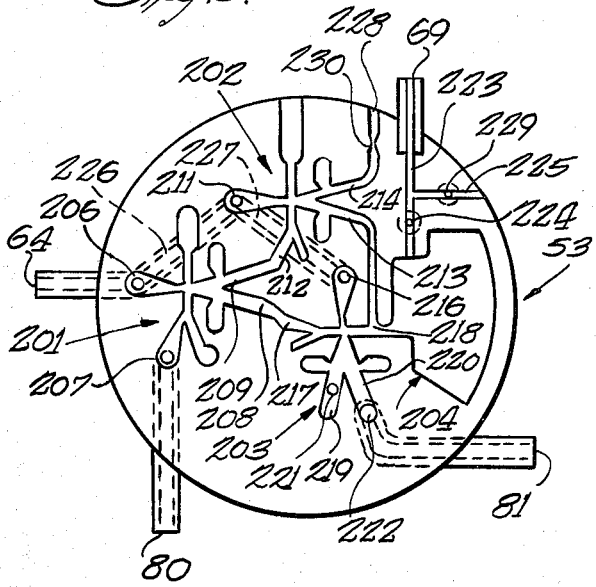
FIG. 3 is a view showing interior passages of a fluid multivibrator used in the fuel system of FIG. 1.

The multivibrator 53 which is included in the first circuit portion is shown in more detail in FIG. 3. The internal passages of multivibrator 53 form three interconnected fluid gating devices and, if desired, can have a configuration similar to that of a control device such as 40. The size and configuration of the internal passages in the multivibrator would be selected in accordance with pressure and flow in the portion of the system with which it is connected.

Multivibrator 53 includes three gating devices 201, 202, 203 and a capacitance 204. Gating device 201 includes a power port 206, a control port 207, and a pair of receiver legs 208, 209. Gating device 202 includes a power port 211, a control port 212, and a pair of receiver legs 213, 214. Gating device 203 includes a power port 216, a pair of opposed control ports 217, 218, and a pair of receiver legs 219, 220. Receiver leg 219 includes a dump port, and receiver leg 220 includes an output port 222. Capacitance chamber 204 is connected to conduit 69 by means of a passage 223 which communicates with ambient by means of passage 225. The restrictors 224 and 229 in passages 223 and 225 provide for charging capacitance chamber 204 at a superambient pressure related to the pressure output of first fluid amplifier 51. The power ports 206, 211 and 216 are connected to pneumatic source 50 by means of conduits 60, 61, 64 and passages 226, 227.

Each of gating devices 201, 202, and 203 is biased toward a preferred receiver leg such that a jet issuing from power port 206 will flow into receiver leg 208 unless a pressure signal is present in control port 207, a jet issuing from power port 211 will flow into receiver leg 213 unless a pressure signal is present in control port 212, and a jet issuing from power port 216 will flow into receiver leg 219 unless a dominating pressure signal is present in control port 217. Control port 207 is connected to receive a pneumatic trigger pulse from signal generator 55 by means of conduits 74 and 80. As mentioned earlier in connection with the description of control device 40, trigger signal generator 55 provides a train of pneumatic pressure pulses which repeat as a function of engine speed. Each pulse provides a pressure rise when the pulse is initiated and a pressure drop when the pulse is terminated, the train of pulses provide a series of pressure rises indicative of engine speed and a series of pressure drops indicative of engine speed.

Multivibrator 53 operates in the following manner. When a trigger pulse is present in control port 207, the jet issuing from power port 206 is shifted to receiver leg 209 which then acts through control port 212 to switch the jet from power port 211 to receiver leg 214 where it exits to ambient through port 228 and restrictor 230. When the above condition exists, the jet issuing from power port 216 enters receiver leg 219 and exits to ambient through dump port 221. When the trigger pulse is terminated such that a pressure drop occurs in control port 207, the jet from power port 206 switches to receiver leg 208 which acts on control port 217 to switch the jet issuing from power port 216 into receiver leg 220. Simultaneously the jet issuing from power port 211 switches to receiver leg 213 and flows to control port 218 and capacitance chamber 204, providing a cancellation signal for switching the jet issuing from power port 216 back to receiver leg 219. The presssure in capacitance chamber 204 determines the time delay required to build the cancellation signal to a sufficient pressure to overcome the pressure in control port 217 and permit the jet to switch away from receiver leg 220 to receiver leg 219. The time delay in switching from leg 220 to leg 219 is inversely related to the pressure in capacitance chamber 204. Thus if the pressure in chamber 204 is higher, the cancellation pressure in control port 218 will build rapidly resulting in a short time delay. On the other hand, if the pressure in capacitance chamber 204 is lower, the cancellation pressure in control port 218 builds more slowly resulting in a long time delay.

Summarizing the operation of multivibrator 53, a pressure pulse is initiated in leg 220 and output port 222 each time a trigger pulse is terminated in control port 207. Each pressure pulse initiated in leg 220 remains for a time duration inversely related to the pressure existing in capacitance chamber 204. Where the trigger pulses present in control port 207 are indicative of engine speed as in revolutions per minute, and where the pressure in capacitance 204, as received from first fluid amplifier 51, is indicative of flow rate of inducted air as in cubic feet per minute, the train of pressure pulses in output port 222 repeat as a function of engine speed in revolutions per minute, each pulse having a time duration proportional to the reciprocal of flow rate of inducted air as minutes per cubic feet. The train of pressure pulses from output port 222 is conducted to a capacitance chamber 56 by means of a conduit 81 where the series of pressure pulses is converted to a steady state pressure. The steady state pressure in chamber 56 is a superambient pressure which is inversely related to the quantity of air inducted into the engine per revolution. The steady state pressure can be stated in algebraic notation as follows:

$$\frac{\frac{\text{Revolutions}}{\text{Minutes}}}{1} \times \frac{1}{\frac{\text{Cubic Feet}}{\text{Minute}}} = \frac{1}{\frac{\text{Cubic Feet}}{\text{Revolution}}}$$

The pressure in capacitance chamber 56 is conducted to comparator 54 by means of conduit 72.

The capacitance chamber 56 can be of very simple construction and is illustrated as a hollow body having a wall 231 defining an enclosed cavity 232. An inlet port 233 is provided for connection to conduit 81, and an outlet port 234 is provided for connection to conduit 72.

Reviewing the operation of the first circuit portion, a subambient pressure in the venturi throat which is indicative of the square of the flow rate of air inducted into the engine, is processed through first fluid amplifier 51, multivibrator 53 and chamber 56 to provide a superambient intermediate output pressure which is inversely indicative of instantaneous engine load.

Figure 4:
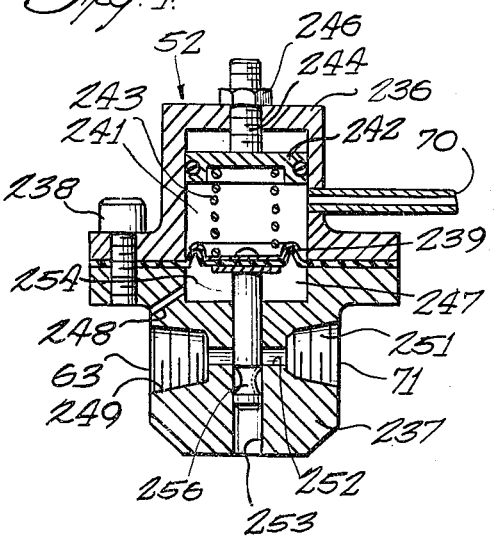
FIG. 4 is a section view of a pneumatic amplifier inverter used in the fuel system of FIG. 1.

The second circuit portion includes second pneumatic amplifier valve 52 and conduits 70, 71, the second amplifier being shown in more detail in FIG. 4. Second amplifier 52 includes an upper body member 236 and a lower body member 237 joined together as by cap screws 238 and securing the margins of a flexible diaphragm 239. Upper body member 236 includes a cylindrical cavity 241 having an adjustable spring seat 242 and spring 243 disposed therein. Spring seat 242 is adjustable with respect to cavity 241 by means of threaded stud 244 and can be secured in a desired position by means of lock nut 246. Spring 243 bears against spring seat 242 and diaphragm 239 urging diaphram 239 downwardly as viewed in FIG. 4. Cavity 241 is intercepted by a port connected to conduit 70.

Lower body member 237 includes a cavity 247 below diaphragm 239 which is vented to ambient by means of passage 248. The lower body member also includes a inlet port 249 adapted for connection to pneumatic source 50 by means of conduits 60, 61 and 63, and an outlet port 251 adapted for connection to comparator 54 by means of conduit 71. A cross passage 252 connects inlet port 249 with outlet port 251 and is intercepted by bore 253. A plunger 254 is connected to diaphram 239 and extends into bore 253, the plunger being slideable in the bore in response to movement of diaphragm 239. Plunger 254 includes a grooved portion 256 which serves to regulate the flow of pneumatic fluid through passage 252 in accordance with the position of diaphragm 239.

The operation of second fluid amplifier 52 is as follows. Cavity 241 is connected to manifold portion 19 by means of conduit 70 such that subambient manifold pressure is present in cavity 241. Ambient pressure in cavity 247 and subambient pressure in cavity 241 urge diaphragm 239 and plunger 254 upwardly as viewed in FIG. 4 such that grooved portion 256 permits flow of pneumatic fluid from inlet port 249 to outlet port 251. Grooved portion 256 acts to throttle flow through passage 251 which regulates the pressure at outlet port 251 in accordance with the position of diaphragm 239.

When the engine is operating at idle, the subambient pressure in manifold portion 19 is strong which results in maximum rise of diaphragm 239 and maximum superambient pressure in outlet port 251. Conversely at wide open throttle, the subambient pressure in manifold portion 19 is weak which results in minimum rise of diaphragm 239 and minimum superambient pressure in outlet port 251. The pressure in outlet port 251 is conducted to comparator 54 by means of conduit 71. Second fluid amplifier 52 thus receives a subambient pressure inversely indicative of instantaneous engine load and provides a superambient intermediate output pressure inversely indicative of instantaneous engine load.

It is to be noted that the intermediate output pressure from the first circuit portion and the intermediate output pressure from the second circuit portion are compatible with each other both as to the character of the signal and the sense of variation with changes in engine load. As a result, the two intermediate pressure signals can be directly compared with each other by comparator 54.

Further it is to be noted that a venturi pressure signal is strongest and most reliable at wide open throttle but tends to disappear near idle whereas the manifold pressure signal is strongest and most reliable at idle and tends to disappear as the engine approaches wide open throttle operation. The intermediate output pressures provided by the first and second circuit portions, when combined with each other, cover the entire operating range of the engine from idle to wide open throttle. The comparator device 54 is employed in the system for effectively combining the intermediate output pressures and providing a resulting bias pressure for the injector control devices.

Figure 5:
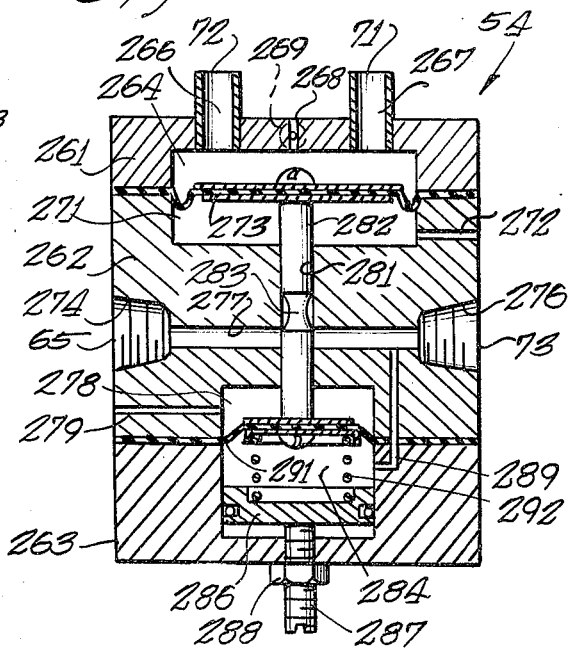
FIG. 5 is a section view of a pneumatic comparator amplifier used in the fuel system of FIG. 1.
Figure 6:
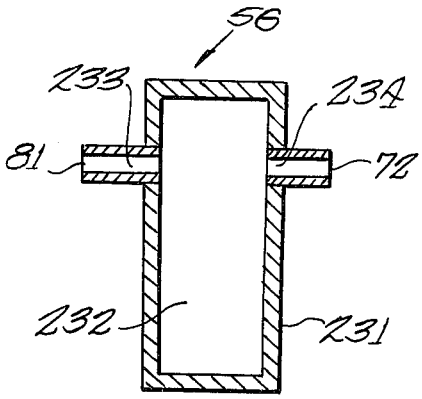
FIG. 6 is a section view of a pneumatic capacitance filter used in the fuel system of FIG. 1.

Comparator device 54 is shown in more detail in FIG. 5. Comparator 54 includes an upper body member 261, an intermediate body member 262, and a lower body member 263. Upper body member 261 includes a cavity 264, a first inlet port 266 for connection to conduit 72, a second inlet port 267 for connection to conduit 71, and a bleed orifice 268 communicating the cavity 264 with ambient. If desired, an adjustable restrictor, such as a screw 269 having a point intercepting orifice 268, can be employed for adjusting the rate of flow through the orifice.

Intermediate body portion 262 includes a cavity 271 and a bleed orifice 272 communicating cavity 271 with ambient. A flexible diaphragm 273 is secured around its margin between upper member 261 and intermediate member 262, having a movable central portion defining a wall between cavities 264 and 271. Intermediate body member 262 also includes an inlet port 274 for connection to conduit 65, an outlet port 276 for connection to conduit 73 and a passage 277 extending therebetween. The lower portion of intermediate body member 262 includes a second cavity 278 which is vented to ambient by means of an orifice 279. A bore 281 extends between cavities 271 and 278 and also intercepts passage 277. A plunger 282 is connected at one end to diaphragm 273 and is slidable in bore 281 in response to movement of diaphragm 273. Plunger 282 includes a groove portion 283 which regulates flow through passage 277 in accordance with the position of diaphragm 273.

Lower body member 263 includes a cavity 284 having an adjustable spring seat 286 disposed therein. Spring seat 286 can be adjusted with respect to the cavity by means of a threaded stud 287 and secured in its adjusted position by means of lock nut 288. A passage 289 extends through portions of lower and intermediate body portions 263, 262 and communicates chamber 284 with passage 277 adjacent outlet port 276. A second flexible diaphragm 291 is secured about its outer margin between lower body member 263 and intermediate body member 262, having an inner movable portion secured to the other end of plunger 282. A spring 292 bears against spring seat 286 and the diaphragm 291, urging the diaphragm and plunger upwardly as viewed in FIG. 5.

The operation of comparator device 54 is as follows. The first and second circuit portions are connected to chamber 264 for admitting the first and second intermediate output pressures thereto by means of inlet ports 266, 267 and conduits 72, 71. The pneumatic fluid supplied to chamber 264 is constantly bled to ambient by means of orifice 268 such that diaphragm 273 and plunger 282 act against biasing spring 292 as the pressure in chamber 264 increases. As the pressure in chamber 264 increases, plunger 282 moves downwardly such that groove portion 283 presents less restriction in passage 277 with the result that the pressure of pneumatic fluid in outlet port 276 and conduit 73 increases. The pressure in outlet port 276 is fed back to the lower side of diaphragm 291 to prevent erratic oscillation of plunger 282 such that pressure changes in outlet port 276 are proportional to pressure changes in chamber 264.

A brief review of the operation of the fuel system is set forth below in terms of amount of air inducted into the engine. At wide open throttle, the engine inducts the greatest amount of air which results in a weak manifold pressure signal and a strong venturi pressure signal. The strong venturi signal is processed through first fluid amplifier 51, multivibrator 53, and capacitance chamber 56 to provide a low superambient first intermediate pressure which is present in chamber 264 and port 267 where it acts on check valve 58 to shut off any second intermediate signal that might result from the manifold pressure. The first low intermediate pressure acts on diaphragm 273 and plunger 282 to provide a low superambient bias pressure in conduit 73 which cooperates with injector control devices such as 40 to provide a long time duration for each injection of fuel into manifold 19. Thus at wide open throttle the engine inducts the greatest amount of air and the injector provides a corresponding amount of fuel.

At part throttle, the engine inducts less air than at wide open throttle and both the venturi and manifold provide useable superambient pressure signals. In this case, first fluid amplifier 51, multivibrator 53 and capacitance chamber 56 process the venturi signal to provide a first intermediate superambient output pressure which is greater than the pressure produced at wide open throttle. At the same time, second fluid amplifier 52 processes the manifold pressure signal to provide a second intermediate superambient pressure which should be identical to the first intermediate pressure, however, in practice the two intermediate pressures may be slightly different in pressure level. The higher of the two intermediate pressures act on diaphragm 273 which reflects a corresponding back pressure in the other circuit portion which closes the corresponding check valve 58 or 57. Movement of diaphragm 273 in response to the prevailing intermediate pressure provides a bias pressure in outlet port 276 and conduit 73 which is greater than the bias pressure at wide open throttle and this new bias pressure cooperates with the injector control devices to reduce the time duration of fuel injection. Thus at part throttle the engine inducts less air and the injector provides correspondingly less fuel.

At idle, the engine inducts very little air which results in a weak, unuseable venturi signal but a strong manifold signal. In this case, second fluid amplifier 52 processes the manifold pressure signal to provide a high superambient second intermediate pressure which prevails in cavity 264, the first intermediate pressure from the venturi having been shut off by check valve 57. The intermediate pressure in cavity 264 being high provides a high bias pressure in outlet port 276 and conduit 73 which cooperates with injector control to provide a very short time duration of fuel injection. Thus at idle when very little air is inducted into the engine, the injector provides correspondingly little fuel.

Thus a preferred embodiment of an improved fuel system has been shown and described in which plural indications of the amount of air inducted into the engine are employed for metering fuel to the engine over a range of operation from idle to wide open throttle.

What is claimed is:

1. A pneumatically controlled fuel injection system for an internal combustion engine having air induction passages defining a venturi portion and a manifold portion, said system including, a pneumatic fluid source, a pneumatically actuated fuel injector connected to said pneumatic source and in fluid communication with a source of fuel and with said manifold portion of said engine, said injector being operable to admit fuel to said manifold portion in response to a pneumatic control pulse, a control device communicating with said pneumatic source and with said injector including means for initiating said control pulse in response to a trigger signal and for sustaining said control pulse for a time interval inversely proportional to a bias pressure, trigger signal generating means connected to said engine and communicating with said pneumatic source and with said control device providing a train of trigger signals having a frequency related to engine speed, and bias pressure generating means communicating with said pneumatic source and with said control device including;

a first pneumatic circuit portion connected to receive a signal from said venturi portion and adapted to provide a first output signal indicative of fuel requirement, a second pneumatic circuit portion connected to receive a signal from said manifold portion and adapted to provide a second output signal indicative of fuel requirement, and comparator means connected to said first and second circuit portions and to said control device providing said bias pressure proportional to one of said first or second output signals indicative of fuel requirement.

2. A pneumatically controlled fuel injection system according to claim 1, said first circuit portion including fluid logic means providing said first output signal in the form of a superambient pneumatic pressure, said second circuit portion including fluid amplifier means providing said second output signal in the form of a superambient pneumatic pressure, said comparator means providing said bias pressure proportional to said first output signal above a selected engine load and providing said bias pressure proportional to said second output signal below said selected engine load.

3. A pneumatically controlled fuel injection system according to claim 1, said first circuit portion including first fluid amplifier means connected to receive a subambient signal from said venturi portion, said first fluid amplifier means being biased for producing a superambient signal indicative of flow rate of air entering said induction passages, said first circuit portion further including fluid multivibrator means connected for receiving said flow rate signal and transforming said flow rate signal to a series of pulses indicative of the reciprocal of flow per revolution, and capacitance means connected to said multivibrator filtering said series of pulses to provide said first output signal in the form of a superambient pneumatic pressure proportional to the reciprocal of air flow inducted into said engine per revolution, said second circuit portion including second amplifier means connected to receive a subambient signal from said intake manifold portion of said induction passage, said second fluid amplifier means providing said second output signal in the form of a superambient pneumatic pressure proportional to the reciprocal of air flow inducted into said engine per revolution.

* * * * *